United States Patent [19]

Vater et al.

[11] 4,308,967

[45] Jan. 5, 1982

[54] PROTECTION RING FOR LIMITING THE WIDTH OF CRACKS IN A STORAGE TANK WALL

[75] Inventors: Richard A. Vater, Pittsburgh; John Terlesky, New Brighton, both of Pa.

[73] Assignee: Pittsburgh-Des Moines Corporation, Pittsburgh, Pa.

[21] Appl. No.: 149,859

[22] Filed: May 22, 1980

[51] Int. Cl.[3] ..... B65D 8/10; B65D 90/00

[52] U.S. Cl. ..... 220/71; 52/248; 220/439; 220/445

[58] Field of Search ..... 220/5 A, 71, 445, 437, 220/439, 71, 1 B; 52/224, 248

[56] References Cited

U.S. PATENT DOCUMENTS

| | | | |
|---|---|---|---|
| 1,166,987 | 1/1916 | Hedrick | 52/224 X |
| 1,251,230 | 12/1917 | Holland et al. | 52/224 |
| 1,940,277 | 12/1933 | Stresau | 220/439 |
| 2,433,335 | 12/1947 | Boardman | 220/71 |
| 2,477,831 | 8/1949 | Schmitz, Jr. | 220/71 X |
| 2,676,729 | 4/1954 | Neville, Jr. et al. | 220/71 |
| 2,731,334 | 1/1956 | Wissmiller | 220/71 X |
| 2,961,118 | 11/1960 | Miller et al. | 220/71 X |
| 3,146,549 | 9/1964 | James | 52/224 |
| 3,207,353 | 9/1965 | Canty et al. | 220/71 X |
| 3,377,757 | 4/1968 | Magers, Jr. | 220/71 X |
| 3,471,053 | 10/1969 | Endicott et al. | 220/71 X |
| 3,523,063 | 8/1970 | Zerng | 52/224 X |
| 3,618,818 | 11/1971 | Puyo | 220/71 |
| 4,093,100 | 6/1978 | Ford et al. | 220/71 X |
| 4,181,237 | 1/1980 | Henyon et al. | 220/71 |

FOREIGN PATENT DOCUMENTS

| | | | |
|---|---|---|---|
| 441904 | 3/1927 | Fed. Rep. of Germany | 220/71 |
| 2816389 | 10/1979 | Fed. Rep. of Germany | 52/224 |
| 177011 | 10/1961 | Sweden | 220/71 |

*Primary Examiner*—Allan N. Shoap

*Attorney, Agent, or Firm*—Shoemaker and Mattare, Ltd.

[57] ABSTRACT

Large openings in a storage tank wall caused by cracks appearing therein are prevented by surrounding such wall with a plurality of rings which are spaced apart from the wall to be structurally independent of that wall. Such structurally independent rings are not susceptible to stressing forces exerted on the wall.

16 Claims, 11 Drawing Figures

PROTECTION RING FOR LIMITING THE WIDTH OF CRACKS IN A STORAGE TANK WALL

BACKGROUND OF THE INVENTION

The present invention relates in general to storage tanks, and, more particularly, to tank integrity protection means.

Storage tanks are used to store many types of materials, such as liquids which include cryogenics, petroleum products, or the like. These tanks can assume extremely large sizes and the liquid tanks can contain millions of gallons of product.

A failure of such liquid tanks can be catastrophic if tank failure is complete. A brittle fracture mode failure of a metal LNG storage tank has been postulated by some members of the LNG industry. Such a fracture has been envisioned as causing the storage tank to be cleaved along all or part of the height thereof. Such a fracture would result in a large opening in the side of the tank through which the stored product would escape. The escaping product would produce a considerable impact load on the wall of a secondary container located outside the primary storage tank. Also, the primary storage tank could be thrust against the wall of the secondary container causing a second, considerable impact. This second impact load would be centered 180° from the first impact load.

Provision of massive walls for secondary containers, or supporting such secondary container walls with an earthen berm are not satisfactory solutions to a problem of adequately protecting a storage tank against a brittle fracture mode failure such as the above-discussed failure. These solutions are not cost efficient, and are not reliable enough to warrant the costs involved therewith.

The assignee of this patent application owns U.S. Pat. No. 3,861,552, issued Jan. 21, 1975, disclosing hoops provided around a tank for providing added structural capability to the tank, wherein the tank hydrostatic pressures require providing plate material thicknesses which require field stress relieving. Such hoops are a part of the tank structure, that is, the hoops and/or other such supports are not structurally isolated from the tank wall. As a result of the structural coupling between the tank wall and the reinforcing means, the stressing forces exerted on the tank wall are transmitted to the reinforcing means, and any cracks appearing in the tank wall may propagate into that structure intended to reinforce the tank wall. The tank wall is thus still susceptible to a catastrophic failure.

Thus, there is need for efficient means for protecting a storage tank against failure by limiting the size of a wall crack.

SUMMARY OF THE INVENTION

The tank protection system embodying the teachings of the present invention protects a storage tank in a manner which limits the size a crack in the wall of such tank can assume, and thereby protects the tank against a catastrophic failure.

The system includes a series of horizontal tension rings provided around the outer periphery of a tank. These rings are not directly attached to the wall of the tank, but rather are held in place by a series of supports.

The rings are spaced from the tank wall to define a gap and to thus be structurally isolated from and independent of the tank wall.

In the event of a fracture of the tank wall, the tank shell will expand to the radius of the rings. The rings will prevent the tank from expanding further. The crack width will be limited to $2\pi\times$ (the initial gap between the tank wall and the rings). The fact that the rings are not directly attached to the tank, but rather are separate entities, is essential to the present invention, since such structural isolation of the rings prevents propagation of the crack from the tank into the rings.

The rings can be placed at any location on the tank wall. The location of the rings should be specifically determined for a given tank. Rings should be located and spaced to minimize the tangential opening in the shell midway between the rings.

The rings are preferably T-shaped in cross-section; however, the rings can be of any shape. The number of rings and their spacing can be of any configuration suitable for restraining the tank. The rings can be of any material, such as steel cable, or the like, which is suitable for the loads and temperatures to which the rings will be subjected.

The support means used for the rings is preferably a plurality of L-shaped brackets attached to the tank, but can be of any shape. The support means can be either a continuous ring or it can be a series of discrete members.

The rings of the present invention are not reinforcing rings, in that these rings do not reinforce the tank wall. Instead, the rings of the present invention are backstops. The tank wall is thus not rendered less susceptible to fracture by the inclusion of the rings of the present invention. Instead, the rings are backstops and are intended to limit the width of a crack which may appear in the tank wall by limiting the amount of radially outward movement permitted for such wall before the wall abuts a ring which stops such outward wall movement. Thus, the tank wall itself is not rendered less likely to fail by the present invention, but the possibility of a catastrophic failure is reduced, if not completely eliminated, by the system embodying the teachings of the present invention. Other systems can be used to reinforce the tank wall if so desired, however, such systems would be used in conjunction with the presently disclosed system and are intended to serve a function and to operate in a manner which both differ from the function and operation of the presently disclosed system. Furthermore, results are achieved by such reinforcing systems which differ from the results achieved by the presently disclosed invention.

OBJECTS OF THE INVENTION

It is a main object of the present invention to control the failure of a liquid storage tank.

It is another object of the present invention to limit the size of a tank wall crack occurring in a liquid storage tank.

These together with other objects and advantages which will become subsequently apparent reside in the details of construction and operation as more fully hereinafter described and claimed, reference being had to the accompanying drawings forming part hereof, wherein like reference numerals refer to like parts throughout.

DETAILED DESCRIPTION OF THE INVENTION

Figure 1:
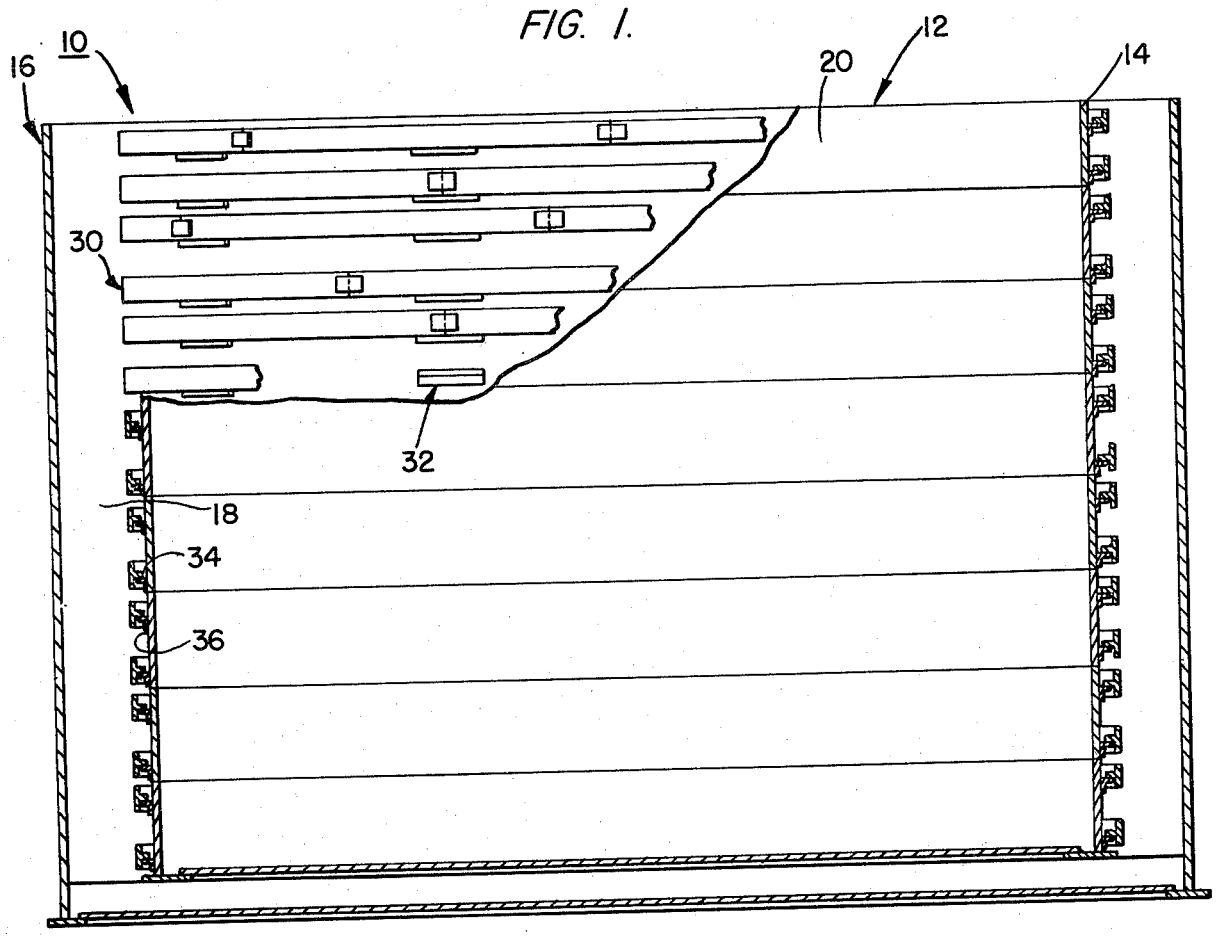
FIG. 1 is an elevation view of a liquid storage tank having a means for limiting the size of wall cracks embodying the teachings of the present invention.

Shown in FIG. 1 is an elevated double wall storage tank 10 which includes a primary tank 12 having a wall 14 and a secondary tank 16 surrounding that tank 12 and spaced therefrom to define an annular space 18. Insulation such as Perlite, or the like, can be located in the annular space 18. It is noted that while the tank 10 is disclosed as a liquid storage tank which is cylindrical in shape, other types of storage tanks can be used without departing from the scope of the present invention. The tank 10 can be partially buried if so desired, and can be a single wall tank, if so desired. The tank can include a plurality of stacked ring sections 20 which are welded together to form the cylindrical primary tank 10.

The tank 10 is used to store liquid, such as cryogenics, or the like, and, as above-discussed, there is some possibility of wall failure with such tanks. Should the tank wall 14 crack, the hydrostatic pressure exerted thereon by the liquid contained in the tank may cause that crack to enlarge and, eventually, cause the wall to rip apart. Such a situation is catastrophic for both the equipment and any personnel in the area. The present invention is directed to ameliorating the effects of the tank wall cracking and/or tearing, and the remainder of the disclosure will describe the structure embodying this invention.

As shown in FIG. 1, a plurality of protection, or tension rings 30 surround the tank 12. Each of the rings rests on a support member 32 attached to the wall of the tank and is spaced from the tank wall 14 to define a gap 34 between the ring and the tank wall outer surface 36. This gap is the essence of the present invention and must be present in all embodiments thereof so that tank wall failure will not be structurally transmitted to any of the rings. The rings are thus backstops which catch a failed tank wall after that wall has expanded a distance corresponding to the size of the gap existing between the tank wall and the ring in the vicinity of the failure. Due to thermal stresses, loadings, and the like, the gap 34 may not be uniform about the perimeter of the tank for one ring, or for adjacent rings; however, this gap need only be present to render the rings effective. The optimum gap size can be determined according to various factors, such as safety factors, materials, tank size, fabrication tolerances, product induced deformations of the tank wall, and the like.

The operation of the rings is evident from the above-presented description. Should a tank wall crack, that wall will expand radially outward on either side of the crack due to the pressure exerted thereon by the fluid contained in the tank. Such pressure may cause the crack to increase in width and length if the tank wall were not backstopped. The expanded tank wall will abut a ring in the area of the crack and thereby be backstopped. The crack will remain, but is not likely to significantly increase in width as the ring prevents further outward movement of the wall.

As the rings are not part of the wall, any cracks in the wall will not be transmitted to any of those rings. If the rings were directly attached to the wall, those rings would be part of the wall and thus susceptible to having wall cracks being transmitted thereto. The gaps 34 prevent such structural coupling.

Figure 3:
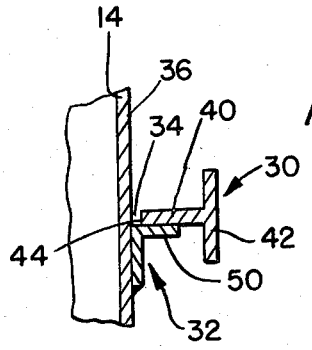
FIG. 3 is a view taken along line 3—3 of FIG. 2.

As shown in FIG. 3, the preferred form of the rings 30 is T-shaped in cross-section with a web 40 oriented essentially horizontally and a leg 42 oriented essentially vertically. The rings 30 in FIG. 3 are oriented with respect to the tank wall to have the web interposed between the tank wall and the leg 42 with the terminal end 44 of the web spaced from the wall outer surface to define gap 34. The rings completely surround the tank wall and each tank ring section 20 preferably has one ring 30, but can have two or more rings, with two rings per section being shown in FIG. 1.

Figure 2:
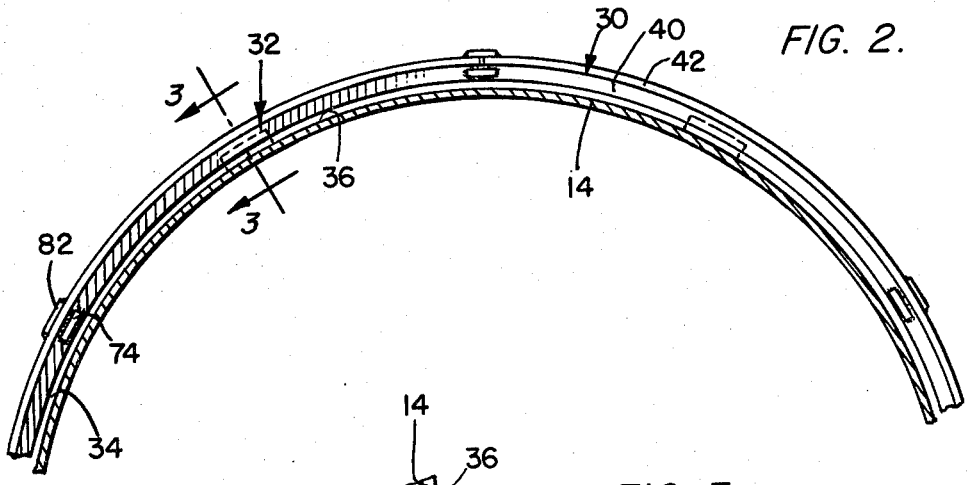
FIG. 2 is a plan view of a portion of the tank shown in FIG. 1.

Each ring is supported on a plurality of brackets 32 which are affixably mounted on the tank wall outer surface as by welding or the like. The brackets 32 are preferably L-shaped and have an upper support surface 50 on which the ring rests, but is not affixed, to be supported thereon. As best shown in FIG. 2, the brackets are circumferentially spaced about the tank wall 14 at positions wherein the support surfaces 50 are all co-level and essentially co-planar for each ring so that the rings are each evenly supported.

Figure 6:
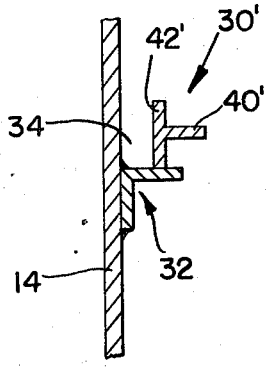
FIGS. 6–9 show alternative embodiments of a protection ring embodying the teachings of the present invention.
Figure 7:
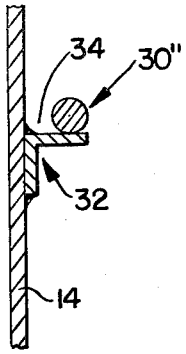
Figure 8:
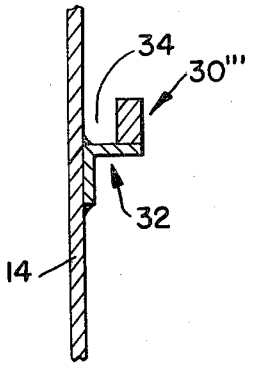
Figure 9:
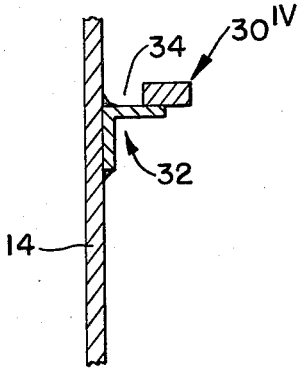

As shown in FIGS. 6–8, the T-shaped ring shown in FIG. 3, while preferred, is not the only shape and/or orientation possible. The ring can be oriented as shown for ring 30′ in FIG. 6 with the leg 42′ interpositioned between the web 40′ and the tank wall, but spaced from the tank wall to define gap 34. The rings can be of various shapes, such as circular in cross-section as shown for ring 30″ in FIG. 7, or polygonal, such as rectangular in cross-section as shown for rings 30‴ and $30^{IV}$ in FIGS. 8 and 9 wherein the ring 30‴ is oriented to be widthwise upright and the ring $30^{IV}$ is oriented to be widthwise horizontal. The gap 34 is indicated for all rings.

Figure 10:
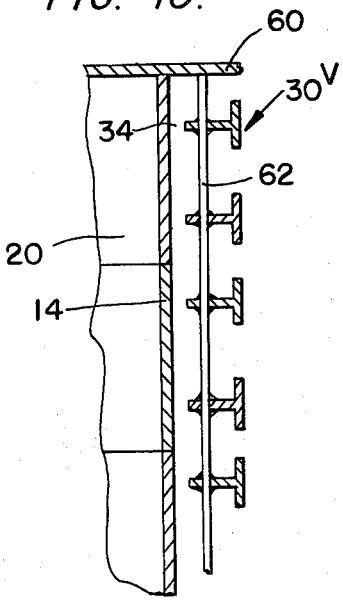
FIGS. 10 and 11 show alternative embodiments of the protection system embodying the teachings of the present invention.
Figure 11:
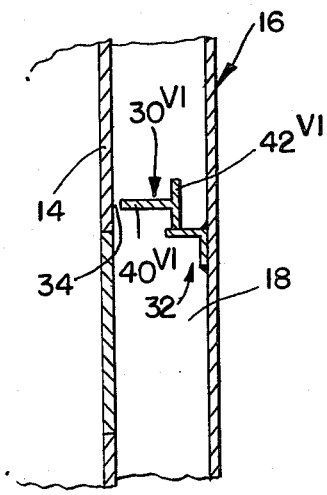

The rings can be supported in ways other than using bracket 32, and two such support means are shown in FIGS. 10 and 11, respectively, as examples of such other ring support means.

The rings $30^{V}$ are shown in FIG. 10 to be pendantly suspended from an overhang structure 60 by a support bar 62. The rings $30^{V}$ are attached to the bar 62 by welding or the like to assume the desired vertical spacing, and the support bars are circumferentially spaced about the tank to provide sufficient support for the rings. The support bar can be affixed at the lower end thereof to the tank base, or some other structure, to maintain the rings spaced from the tank wall as shown in FIG. 10.

A bracket 32′ is attached to the inside surface of secondary wall 16, and a ring $30^{VI}$ has a leg $42^{VI}$ resting thereon to present web $40^{VI}$ thereof toward the tank wall 14 with a gap 34 defined therebetween.

Other ring and support configurations and orientations can be used without departing from the scope of the present disclosure, and the above-discussed forms are presented as examples and are not presented for the purpose of limiting the scope of this disclosure.

Figure 4:
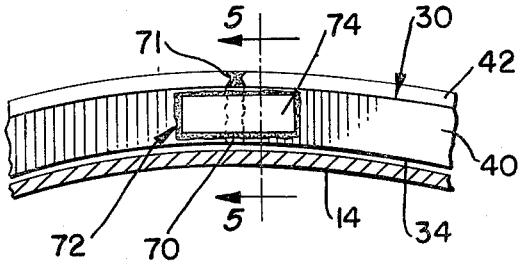
FIG. 4 is an elevation view of a portion of a protection ring embodying the teachings of the present invention showing a splice joint in such ring.
Figure 5:
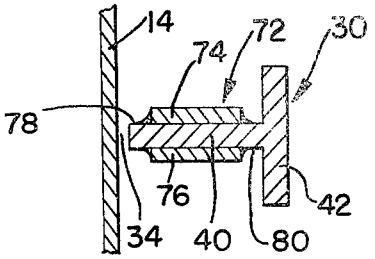
FIG. 5 is a view taken along line 5—5 of FIG. 4.

The rings can be unitary, but preferably are segmental. The segments of each ring are shipped to a tank site, then assembled at that site to form the completed rings. Butt welds can be used to couple the ring segments together, and full penetration butt welds 70 and 71 are shown in FIG. 4 to couple the webs and the legs of conjoined segments. Ring reinforcing means 72 can be used to reinforce the ring segment connections. As discussed above, the rings are supported on a plurality of supports 32. For the sake of clarity, supports are not shown in FIGS. 4 and 5; however, it will be understood by one skilled in the art that the rings are supported to surround the tank wall. As shown in FIGS. 4 and 5, splice plates 74 and 76 span the joined ring segment ends and each are attached to the conjoined ring segments to reinforce that attachment joint. The plates are preferably located on top and bottom surface 78 and 80 of the ring segments respectively. As shown in FIG. 2, a further splice plate 82 can be used to bridge the joint on the leg 42. The splice plates are arcuate to conform with the ring segment shapes at that joint. While fillet welding is the preferred form of attachment between the splice plates and the ring segments, other attaching means, such as bolts, or a combination of welds and bolts, or the like, can be used without departing from the scope of the present disclosure. The splice plate form shown in FIG. 2 is the form having the greatest strength per unit weight of several forms analyzed.

It is noted that the rings are not attached to the support means in the FIGS. 3–9 forms of the invention to further insure the structural isolation between the rings and the tank. However, the FIGS. 10 and 11 forms can have the rings attached to the support means because the support means themselves in these embodiments are structurally isolated from the tank walls. Thus, if the support means is structurally distinct from the tank wall, the rings can be affixed thereto, however, if not, the rings should not be affixed to such attached support means.

Preferably, the rings are metal, but can be other materials which satisfy the containment and restraint requirements. The tanks can be metal, aluminum, concrete, reinforced plastic, or the like.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

We claim:

1. A means of limiting the width of a crack which may occur in a vertical wall of a storage tank comprising:

a support means affixed to the wall;

a protection ring which is horizontally disposed about the vertical wall which is supported by said support means in a manner which permits said support means and said protection ring to move independently of and relative to each other, said protection ring surrounding the vertical wall of a storage tank, said ring being spaced from such wall and defining an uninterrupted gap between said ring and any element of the wall so that said ring is structurally distinct from the wall, said ring unrestrainably surrounding the tank wall so that no force is applied to that wall by said ring until a crack in the wall causes that wall to expand a distance corresponding to the size of said gap, said ring abutting a cracked, expanded wall to prevent widening of that crack beyond a size determined by the size of said gap.

2. The means defined in claim 1 further including a plurality of protection rings which are spaced apart vertically with respect to the tank wall.

3. The means defined in claim 1 wherein said support means is mounted on the tank wall.

4. The means defined in claim 1 wherein said protection ring is tee shaped in cross-section.

5. The means defined in claim 4 wherein said protection ring includes a horizontal web and a vertical leg with said web being located between said leg and the tank wall.

6. The means defined in claim 1 wherein said protection ring is polygonal in cross-sectional shape.

7. The means defined in claim 1 wherein said protection ring is circular in cross-sectional shape.

8. The means defined in claim 1 wherein said protection ring includes a plurality of sections which are connected together.

9. The means defined in claim 8 wherein said protection ring further includes a splice plate at the connections between sections.

10. The means defined in claim 1 wherein the tank is a double wall tank.

11. The means defined in claim 10 wherein said support means is mounted on a secondary wall surrounding the first mentioned wall.

12. The means defined in claim 11 wherein said protection ring is tee shaped in cross-sectional shape.

13. The means defined in claim 1 wherein the tank includes a plurality of tank rings and further including a protection ring on each tank ring.

14. The means defined in claim 11 wherein said tee shaped ring includes a vertical portion and a horizontal portion extending from said vertical portion toward the tank wall.

15. A means of limiting the width of a crack which may occur in a wall of a storage tank comprising:

a support means, said support means including an outwardly extending plate on the top of the storage tank and a plurality of bars each pendantly suspended from said plate and spaced from said tank wall about the periphery thereof;

a protection ring affixed to said support means and surrounding a wall of a storage tank, said ring being spaced from such wall and defining an uninterrupted gap between said ring and any element of the wall so that said ring is structurally distinct from the wall, said ring unrestrainably surrounding the tank wall so that no force is applied to that wall by said ring until a crack in the wall causes that wall to expand a distance corresponding to the size of said gap, said ring abutting a cracked, expanded wall to prevent widening of that crack beyond a size determined by the size of said gap.

16. The means defined in claim 15 further including a plurality of protection rings which are spaced apart vertically with respect to the tank wall.

* * * * *